US008941334B2

(12) United States Patent
Braun et al.

(10) Patent No.: US 8,941,334 B2
(45) Date of Patent: Jan. 27, 2015

(54) METHOD AND OPERATING DEVICE FOR MINIMIZING THE INSULATION STRESS OF A HIGH-PRESSURE DISCHARGE LAMP SYSTEM

(75) Inventors: Alois Braun, Neuburg (DE); Joachim Mühlschlegel, Gröbenzell (DE)

(73) Assignee: OSRAM Gesellschaft mit beschränkter Haftung, Munich (DE)

( * ) Notice: Subject to any disclaimer, the term of this patent is extended or adjusted under 35 U.S.C. 154(b) by 687 days.

(21) Appl. No.: 12/933,641

(22) PCT Filed: Mar. 19, 2008

(86) PCT No.: PCT/EP2008/053292

§ 371 (c)(1), (2), (4) Date: Sep. 20, 2010

(87) PCT Pub. No.: WO2009/115120

PCT Pub. Date: Sep. 24, 2009

(65) Prior Publication Data

US 2011/0018459 A1 Jan. 27, 2011

(51) Int. Cl.
*H05B 37/02* (2006.01)
*H05B 41/04* (2006.01)

(52) U.S. Cl.
CPC ..... *H05B 41/042* (2013.01); *Y10S 315/07* (2013.01)
USPC ..... 315/360; 315/DIG. 7

(58) Field of Classification Search
USPC ..... 315/209 R, 209 SC, 209 PZ, 209 M, 315/209 T, 360, 209 CD, 246, 291, DIG. 7
See application file for complete search history.

(56) References Cited

U.S. PATENT DOCUMENTS

| | | | | |
|---|---|---|---|---|
| 4,329,621 | A * | 5/1982 | Barakitis et al. | 315/47 |
| 4,763,044 | A * | 8/1988 | Nuckolls et al. | 315/176 |
| 5,070,279 | A * | 12/1991 | Garbowicz et al. | 315/289 |
| 5,572,093 | A * | 11/1996 | Kiefer | 315/289 |
| 5,962,981 | A * | 10/1999 | Okude et al. | 315/128 |
| 6,559,608 | B2 * | 5/2003 | Wicklund et al. | 315/308 |
| 7,432,670 | B2 * | 10/2008 | Yamashita et al. | 315/362 |
| 8,040,074 | B2 * | 10/2011 | Goriki et al. | 315/287 |
| 2003/0052622 | A1 | 3/2003 | Okamoto et al. | |
| 2007/0063659 | A1 | 3/2007 | Yaamashita et al. | |

FOREIGN PATENT DOCUMENTS

| | | |
|---|---|---|
| CN | 1409169 | 4/2003 |
| CN | 1895006 | 1/2007 |
| EP | 1 128 709 | 8/2001 |
| JP | 63 307695 | 12/1988 |
| JP | 2005-108800 | 4/2005 |

* cited by examiner

*Primary Examiner* — Thuy Vinh Tran
(74) *Attorney, Agent, or Firm* — Cozen O'Connor

(57) ABSTRACT

A method for minimizing the insulation stress of a high-pressure discharge lamp system, with an operating device, which generates a high voltage for starting the high-pressure discharge lamp, wherein a starting voltage time sum applied during lamp starting is minimized, the starting voltage time sum is the sum of all time segments $Z_i$ during which the magnitude of the starting voltage exceeds a starting voltage limit, and the starting voltage limit is defined as the factor range of a maximum value, in terms of magnitude, of the applied high voltages.

17 Claims, 3 Drawing Sheets

Figure 1A:
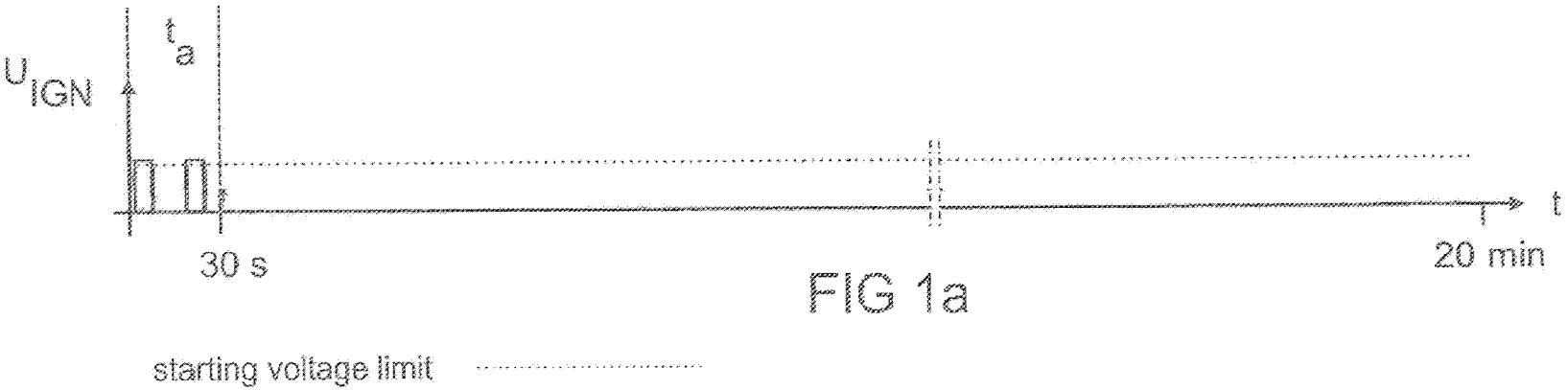

METHOD AND OPERATING DEVICE FOR MINIMIZING THE INSULATION STRESS OF A HIGH-PRESSURE DISCHARGE LAMP SYSTEM

RELATED APPLICATIONS

This is a U.S. national stage of application No. PCT/EP2008/053292, filed on Mar. 19, 2008, the entire content of which is hereby incorporated by reference.

The invention relates to a method for minimizing the insulation stress during starting of a high-pressure discharge lamp, with an operating device, which generates a high voltage for starting the high-pressure discharge lamp and implements said method.

PRIOR ART

Field of the Invention

Conventional operating devices for high-pressure discharge lamps usually use a very simple method for starting a high-pressure discharge lamp. High-voltage pulses are applied to the high-pressure discharge lamp (also referred to below as lamp), said high-voltage pulses having a voltage which is sufficient for generating a dielectric breakdown between the lamp electrodes in the discharge lamp. Since not every lamp starts immediately with the first starting pulse, a large number of starting pulses is applied to the lamp, said starting pulses being combined to form so-called starting pulse bursts. A large number of these starting pulse bursts is emitted to the lamp with a predetermined interval, as can be seen from FIG. 3. Particularly in the case of operating devices which do not permit hot restarting of the high-pressure discharge lamp, it may arise that a lamp is switched off and immediately switched on again thereafter. In this case, however, the lamp is too hot to be able to restarted with the operating device. Therefore, these operating devices are designed such that they repeatedly emit starting pulse bursts to the lamp for a time of approximately 20 min-25 min with short intervals in order to be able to restart a lamp which is cooling down as quickly as possible (see FIG. 3). If such a case occurs, the entire insulation in the high-voltage region of the lamp system is subjected to many hundreds to thousands of unnecessary high-voltage pulses. Naturally, this also applies in the case where there is no lamp provided.

In the case of a missing lamp, the entire insulation is subjected to a particularly high load. It has been demonstrated that precisely the often very long bursts in the case of many devices with a large number of high-voltage pulses in quick succession are damaging for the entire high-voltage insulation and it becomes evermore probable that the insulation will fail over the course of time.

Insulation stress is used below to refer to high-voltage pulses being applied to the entire insulation of a high-pressure discharge lamp system from the circuit arrangement which generates the high voltage to the high-pressure discharge lamp burner, which is generally installed in an outer bulb. The entire insulation is understood to mean all of the insulating parts of the arrangement from the high-voltage source to the high-pressure discharge lamp burner, i.e., for example, cables, plugs, lamp base and outer bulb insulation. High voltage is understood to mean all that the high-voltage source generates for the purpose of starting the lamp using high voltage. In this case, it is not important whether the high voltage is generated via a pulse starting method or a resonant starting method.

SUMMARY OF THE INVENTION

One object of the invention is to provide a method for minimizing the insulation stress during starting of a high-pressure discharge lamp, which method can be implemented by an operating device which generates a high voltage for starting the high-pressure discharge lamp.

Another object of the invention is to provide an operating device which implements this method.

These and other objects are achieved according to one aspect of the invention directed to a method for minimizing the insulation stress of a high-pressure discharge lamp system with an operating device, which generates a high voltage for starting the high-pressure discharge lamp, wherein a starting voltage time sum applied during starting of the lamp is minimized. The starting voltage time sum is the sum of all time segments $Z_i$ during which the magnitude of the starting voltage exceeds a starting voltage limit. The starting voltage limit is defined as the factor range of a maximum value, in terms of magnitude, of the applied high voltages. The maximum value, in terms of magnitude, is in this case the maximum value of the magnitude of the voltage which occurs in total for at least 2 μs while the starting voltage is applied.

The factor range is in this case preferably between 0.6 and 0.95, particularly preferably between 0.8 and 0.9. As a result, only voltages which are applied to the high-pressure discharge lamp and which firstly also actually contribute to the starting, but secondly also subject the insulation to stress to a significant degree are counted for the method according to the invention.

If the ratio $$\frac{\sum_{i=0}^{n1} Z_i}{\sum_{i=n1+1}^{n2} Z_i}$$

of the starting voltage time sum of a first time span ($t_a|n=0 \ldots n1$) to the starting voltage time sum of a second time span ($t_b|n=n1+1 \ldots n2$) is greater than ¼, this provides the advantage of low insulation stress. In the case where the ratio $$\frac{\sum_{i=0}^{n1} Z_i}{\sum_{i=n1+1}^{n2} Z_i}$$

of the starting voltage time sum of a first time span ($t_a|n=0 \ldots n1$) to the starting voltage time sum of a second time span ($t_b|n=n1+1 \ldots n2$) is greater than ½, the advantage of low insulation stress is particularly great.

The duration of the first time span ($t_a$) is preferably between 1 s and 2 min long, particularly preferably between 30 s and 1 min long. The duration of the second time span ($t_b$), on the other hand, is preferably between 15 min and 25 min long, particularly preferably is 20 min.

If, in the first time span ($t_a$), starting pulse bursts with a burst duration of 0.5 s-1.5 s with an interval between two starting pulse bursts of 7 s-35 s are generated, a cold high-pressure discharge lamp can be started particularly well. The starting pulse bursts generated in the second time span ($t_b$) with a burst duration of 0.05 s-0.15 s with an interval between two starting pulse bursts of 30 s-7 min are optimized for starting a hot high-pressure discharge lamp. If, in the second time span ($t_b$), a lamp breakdown is detected, the generation of a starting pulse burst with a burst duration of 0.5 s-1.5 s can start the high-pressure discharge lamp better still. This measure makes it possible to generate safe lamp starting from a first dielectric breakdown.

If a preceding, measured switch-off duration of the high-pressure discharge lamp is ≥20 min long, starting pulse bursts with a burst duration of 0.5 s-1.5 s which have an interval between two starting pulse bursts of 7 s-35 s are preferably generated for a first time span ($t_a$). It is thus possible for a cold high-pressure discharge lamp to be started in optimum fashion, and further starting pulses are not required.

In the case of a preceding, measured switch-off duration of less than 20 min, starting pulse bursts with a burst duration of 0.5 s-1.5 s are generated for a first time span ($t_a$) and starting pulse bursts with a burst duration of 0.05 s-0.15 s are generated for a second time span ($t_b$). The interval between two starting pulse bursts for the first time span ($t_a$) is in this case 7 s-35 s, and the interval between two starting pulse bursts for the second time span ($t_b$) is in this case 30 s-7 min. These values provide the advantage that, firstly, hot lamps can be started easily without a damaging effect on the insulation, and secondly, in the event of a lamp replacement, a cold lamp which is then identified as hot is nevertheless started easily.

BRIEF DESCRIPTION OF THE DRAWING(S)

The invention will be explained in more detail below with reference to exemplary embodiments. In the drawings:

FIG. 1*a* shows an illustration of a first method according to an embodiment of the invention for minimizing the insulation stress during starting of a high-pressure discharge lamp for the case of a cold lamp.

Figure 1B:
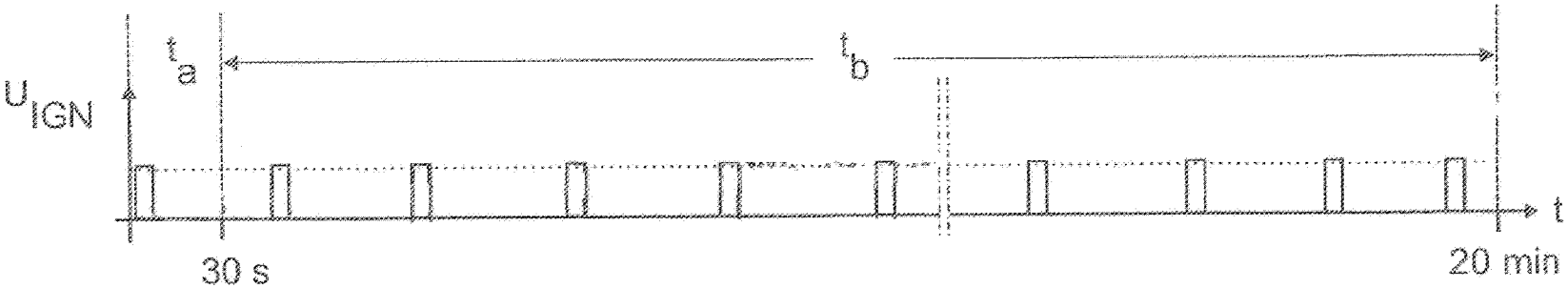

FIG. 1*b* shows an illustration of a first method according to an embodiment of the invention for minimizing the insulation stress during starting of a high-pressure discharge lamp for the case of a hot lamp.

Figure 2A:
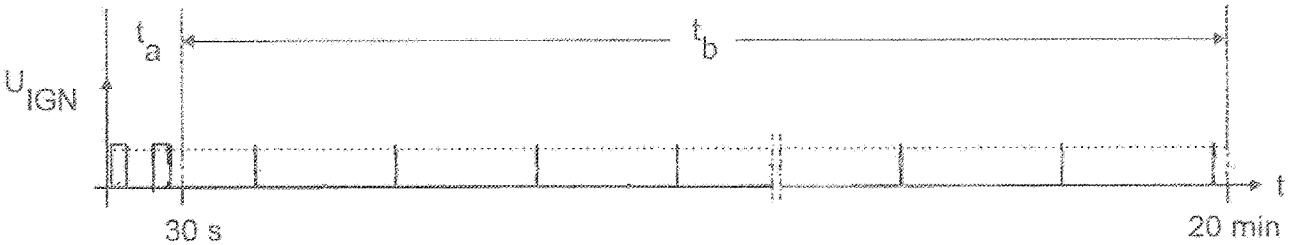

FIG. 2*a* shows an illustration of a second method according to an embodiment of the invention for minimizing the insulation stress during starting of a high-pressure discharge lamp in a first variant.

Figure 2B:
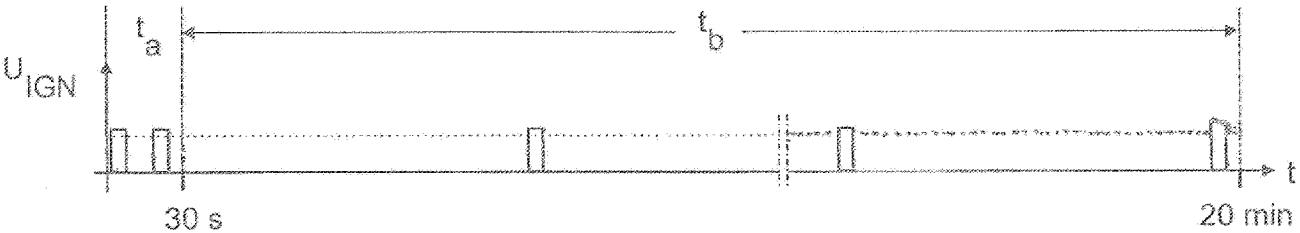

FIG. 2*b* shows an illustration of a second method according to an embodiment of the invention for minimizing the insulation stress during starting of a high-pressure discharge lamp in a second variant.

Figure 2C:
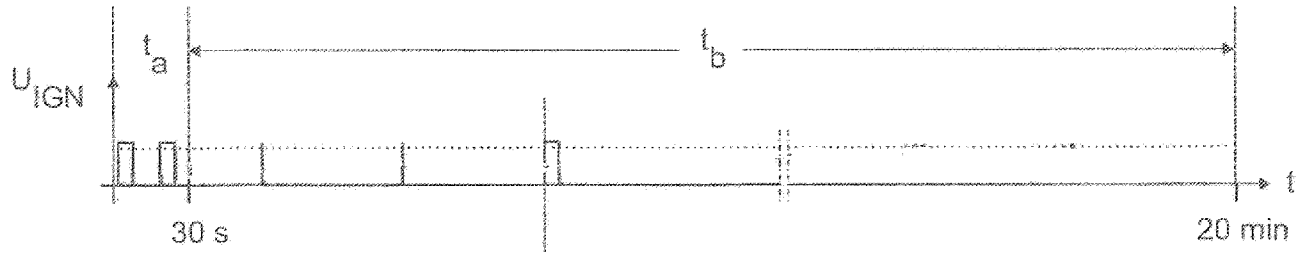

FIG. 2*c* shows an illustration of a second method according to an embodiment of the invention for minimizing the insulation stress during starting of a high-pressure discharge lamp in a third variant.

Figure 3:
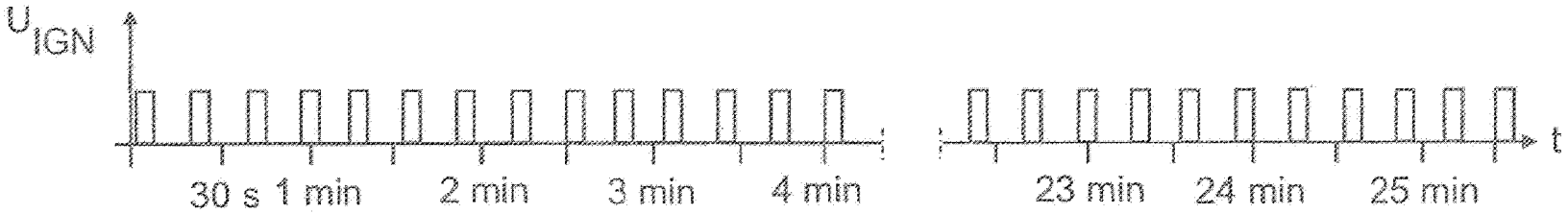
FIG 3 (Prior Art)

FIG. 3 shows an illustration of a method for starting a high-pressure discharge lamp in accordance with the prior art.

DETAILED DESCRIPTION OF THE DRAWINGS

FIG. 1*a* shows a graphical illustration of a first method according to the invention for minimizing the insulation stress during starting of a high-pressure discharge lamp for the case of a cold lamp. The starting voltage applied to the lamp is plotted on the vertical axis, and the time which has elapsed since the first starting pulse z is plotted on the horizontal axis. Since a cold lamp can be started immediately, only a few starting pulse bursts need to be applied successively to the lamp. If the lamp has not yet started, it must be assumed from this that it is defective or that there is no lamp present. In the present exemplary embodiment, there are two successively implemented starting pulse bursts which do, however, have a very long burst duration for overcoming the poor ionization of the lamp in the cold state. By way of summary it can be said that a starting voltage with a first intensity $IN_{ta}$ is applied to the lamp for a predetermined first time span in order to start said lamp. After this predetermined first time, no more starting pulses are applied to the lamp. In this case, the intensity is the sum of all the starting pulses Z applied to the lamp in this time span per unit time or the absolute temporal duration of the starting voltage applied to the high-pressure discharge lamp during the first time span per unit time.

FIG. 1*b* shows a graphical illustration of a first method according to the invention for minimizing the insulation stress during starting of a high-pressure discharge lamp for the case of a hot lamp. In this state, the lamp needs to first be cooled in order to be able to start, and therefore permanently applying starting pulses to the lamp from the start, as is described in the prior art, is not optimum. An optimized method is therefore used, with said method providing relatively long time spans between the starting pulses. Since the lamp state measurement implemented in the operating device is under certain circumstances very imprecise, it may be that the lamp has already cooled down to a significant extent and is therefore already capable of starting after a short period of time. Therefore, starting pulses are nevertheless generated from the start in order to cover this eventuality. Also, for the case in which an old lamp which is running is switched off in order to be replaced shortly thereafter by a new cold lamp, it is necessary to provide for such an eventuality since the operating device does not know whether a lamp has been replaced. Therefore, as in the case of a cold lamp, a starting voltage with a first intensity $IN_{ta}$ is applied to the lamp for a predetermined first time span $t_a$. Then, a starting voltage with a predetermined second intensity $IN_{tb}$ is applied to the lamp for a predetermined second time span $t_b$. In this case, the predetermined second time span $t_b$ is markedly longer than the predetermined first time span $t_a$. For this purpose, the predetermined second intensity $IN_{tb}$ of the starting voltage is lower than the predetermined first intensity $IN_{ta}$. If starting pulses are applied to the lamp, the predetermined first intensity $IN_{ta}$ can be considered to be the sum of all the time segments of the starting voltage which are applied in this time span (starting voltage time sum) for this time span:

$$IN_{ta} = \frac{\sum_{i=0}^{n1} Z_i}{t_a}.$$

Here, as already mentioned above, Z are the time segments during which the magnitude of the starting voltage exceeds a starting voltage limit, and the starting voltage limit is defined as the factor range of a maximum value, in terms of magnitude, of the applied high voltages. The number of individual time segments in this period is n1. Similarly, the following then applies for the predetermined second time span:

$$IN_{tb} = \frac{\sum_{i=n1+1}^{n2} Z_i}{t_b}.$$

FIG. 2*a* shows an illustration of a second method according to the invention for minimizing the insulation stress during starting of a high-pressure discharge lamp in a first variant.

The second method according to the invention is a simplified variant, in which no state measurement of the lamp is performed. As a result, the operating device can be designed to be markedly simpler and therefore less expensive. Since the operating device does not now identify the state of the lamp, however, the method needs to be suitable for both cold and hot lamps. Since it has been demonstrated that cold lamps require starting pulse bursts with a relatively long burst duration for optimum starting as a result of their low tendency to ionization, a few long starting pulse bursts for the time span $t_a$ are generated at the start, as in the first method according to the invention, when the lamp is hot. If the lamp has not started despite the long bursts, the lamp is probably not cold, but is still too hot, and therefore the method according to the invention changes strategy and lengthens the breaks between the starting pulse bursts in the subsequent time span $t_b$. It has likewise been demonstrated that starting pulse bursts with a short burst duration are sufficient for starting the lamp in the case of hot lamps as a result of their temperature. Therefore, not only are the breaks extended, but also the burst duration is markedly reduced. These measures ensure a significant reduction in the starting voltage time sum $$\sum_{i=0}^{n2} Z_i$$

applied to the lamp, wherein n2 is the sum of the pulses from the first time span $t_a$ and the pulses from the second time span $t_b$.

FIG. 2*b* shows an illustration of a second method according to the invention for minimizing the insulation stress during starting of a high-pressure discharge lamp in a second variant. The second variant is similar to the first variant; only the strategy for the starting of a hot lamp is different. In the second variant, in order to start a hot lamp with very large intervals for the time span $t_b$, a starting pulse burst which is equal to that for coldstarting is applied to the lamp. By virtue of the fact that the intervals between the starting pulse bursts are even greater than in the first variant, the starting voltage time sum during the time span $t_b$ can likewise be reduced markedly in comparison with the prior art. This variant is suitable for high-pressure discharge lamps which have a low starting capacity even in the hot state, for which reason this second variant also defines starting pulse bursts with a longer burst duration (in comparison with the first variant) for hot-starting.

In a third variant, which is illustrated in FIG. 2*c*, the methods in accordance with the first and second variants are combined. In this case, too, first the above-described coldstarting is performed for the time span $t_a$ with a few long starting pulse bursts. Then, the system switches over to a starting strategy as in the first variant. Short starting pulse bursts are applied to the lamp with relatively large intervals for the time span $t_b$. If the operating device detects a breakdown between the lamp electrodes at time $t_i$, the starting pulse burst is extended markedly in order to start the lamp safely thereafter. With this strategy it is possible to achieve a significant reduction in the starting voltage time sum whilst at the same time improving the lamp starting. The entire insulation in the high-voltage range, i.e. even the lampholder and the leakage paths in the operating device, are thus protected.

It has been demonstrated for both methods and variants according to the invention that there are certain optimum values for both time spans $t_a$ and $t_b$. The duration of the first time segment $t_a$ is between 1 s and 2 min, particularly advantageously between 30 s and 1 min. The duration of the second time segment is 15 min to 25 min, particularly advantageously approximately 20 min.

The limit for which a high voltage applied to the lamp is still regarded as starting voltage pulse z is defined as the starting voltage limit. The starting voltage limit is in the range of from 60% to 95%, advantageously in the range of from 80% to 90% of the maximum value, in terms of magnitude, of all of the magnitudes of the high voltages applied to the lamp in the time segment $t_a$ and in the time segment $t_b$. The maximum value, in terms of magnitude, is in this case the maximum value of the magnitude of the voltage which occurs in total for at least 2 μs while the starting voltage is applied.

In order to optimize the starting voltage response of the lamp, it is advantageous if the ratio $$\frac{\sum_{i=0}^{n1} Z_i}{\sum_{i=n1+1}^{n2} Z_i}$$

of the starting voltage time sums of the first and second time segments fluctuates within a certain range. A ratio of ¼ is good, while a ratio of ½ is particularly advantageous.

The ratio of the starting voltage time sums in accordance with the prior art fluctuates within the range of from 1/10 to 1/40, which results in a significantly higher insulation stress than with the method according to the invention.

The scope of protection of the invention is not limited to the examples given hereinabove. The invention is embodied in each novel characteristic and each combination of characteristics, which includes every combination of any features which are stated in the claims, even if this feature or combination of features is not explicitly stated in the examples.

The invention claimed is:

1. A method for minimizing the insulation stress of a high-pressure discharge lamp system, the method comprising:

generating a high voltage to produce a starting voltage for starting the high-pressure discharge lamp system;

applying a starting voltage time sum during lamp starting, wherein the starting voltage time sum is the sum of all time segments ($Z_i$) during which a magnitude of the starting voltage exceeds a starting voltage limit, wherein the starting voltage limit is defined as a factor range of a maximum value, in terms of magnitude, of the high voltage, and wherein the ratio $$\frac{\sum_{i=0}^{n1} Z_i}{\sum_{i=n1+1}^{n2} Z_i}$$

of the starting voltage time sum of a first time span ($t_a$|n=0 . . . n1) to the starting voltage time sum of a second time span ($t_b$|n=n1+1 . . . n2) is greater than ¼.

2. The method as claimed in claim 1, wherein the factor range is between 0.6 and 0.95.

3. The method as claimed in claim 1, wherein the factor range is between 0.8 and 0.9.

4. The method as claimed in claim 1, wherein the ratio $$\frac{\sum_{i=0}^{n1} Z_i}{\sum_{i=n1+1}^{n2} Z_i}$$

of the starting voltage time sum of a first time span ($t_a$|n=0n1) to the starting voltage time sum of a second time span ($t_b$|n=n1+1 . . . n2) is greater than ½.

5. The method as claimed in claim 1, wherein the duration of the first time span ($t_a$) is between 1 and 2 s.

6. The method as claimed in claim 1, wherein the duration of the first time span ($t_a$) is between 30 s and 1 min.

7. A method for minimizing the insulation stress of a high-pressure discharge lamp system, the method comprising:

generating a high voltage to produce a starting voltage for starting the high-pressure discharge lamp system;

applying a starting voltage time sum during lamp starting, wherein the starting voltage time sum is the sum of all time segments $Z_i$ during which a magnitude of the starting voltage exceeds a starting voltage limit, wherein the starting voltage limit is defined as a factor range of a maximum value, in terms of magnitude, of the high voltage, and wherein the ratio $$\frac{\sum_{i=0}^{n1} Z_i}{\sum_{i=n1+1}^{n2} Z_i}$$

of the starting voltage time sum of a first time span ($t_a$|n=0 . . . n1) to the starting voltage time sum of a second time span ($t_b$|n=n1+1 . . . n2) is greater than ¼, and wherein the duration of the second time span ($t_b$) is between 15 min and 25 min.

8. The method as claimed in claim 7, wherein, in the first time span ($t_a$), generating starting pulse bursts with a burst duration of 0.5 s-1.5 s with an interval between two starting pulse bursts of 7 s-35 s.

9. The method as claimed in claim 8, wherein, in the second time span ($t_b$), generating starting pulse bursts with a burst duration of 0.05 s-0.15 s with an interval between two starting pulse bursts of 30 s-7 min.

10. The method as claimed in claim 8, wherein when a lamp breakdown is detected in the second time span ($t_b$), generating a starting pulse burst with a burst duration of 0.5 s-1.5 s.

11. The method as claimed in claim 7, wherein, in the case of a preceding, measured switch-off duration, the longer the preceding, measured switch-off duration is, the greater the ratio $$\frac{\sum_{i=0}^{n1} Z_i}{\sum_{i=n1+1}^{n2} Z_i}$$

of the starting voltage time sums is set to be.

12. The method as claimed in claim 11, wherein, after a certain switch-off duration in a range of from 15 min to 25 min, the ratio $$\frac{\sum_{i=0}^{n1} Z_i}{\sum_{i=n1+1}^{n2} Z_i}$$

of the starting voltage time sums reaches a maximum.

13. The method as claimed in claim 11, wherein, in the case of the preceding, measured switch-off duration being greater than or equal to 20 min, generating starting pulse bursts with a burst duration of 0.5 s-1.5 s for the first time span ($t_a$).

14. The method as claimed in claim 13, wherein the interval between two starting pulse bursts is 7 s-35 s.

15. The method as claimed in claim 7, wherein, in the case of a measured, preceding switch-off duration being less than 20 min, generating starting pulse bursts with a burst duration of 0.5 s-1.5 s for the first time span ($t_a$) and generating starting pulse bursts with a burst duration of 0.05 s-0.15 s for the second time span ($t_b$).

16. The method as claimed in claim 15, wherein the interval between two starting pulse bursts is 7 s-35 s for the first time span ($t_a$), and the interval between two starting pulse bursts is 30 s-7 min for the second time span ($t_b$).

17. The method as claimed in claim 7, wherein the duration of the second time span ($t_b$) is 20 min.

* * * * *